US012044445B2

(12) United States Patent
Feng et al.

(10) Patent No.: US 12,044,445 B2
(45) Date of Patent: Jul. 23, 2024

(54) HEAT PUMP SYSTEM, DEFROSTING METHOD FOR A HEAT PUMP SYSTEM, AND CONTROLLER

(71) Applicant: CARRIER CORPORATION, Palm Beach Gardens, FL (US)

(72) Inventors: Xi Feng, Shanghai (CN); Guangyu Shen, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 684 days.

(21) Appl. No.: 17/059,929

(22) PCT Filed: Sep. 5, 2019

(86) PCT No.: PCT/US2019/049668
§ 371 (c)(1),
(2) Date: Nov. 30, 2020

(87) PCT Pub. No.: WO2020/055653
PCT Pub. Date: Mar. 19, 2020

(65) Prior Publication Data

US 2021/0215403 A1 Jul. 15, 2021

(30) Foreign Application Priority Data

Sep. 14, 2018 (CN) ..... 201811073685.7

(51) Int. Cl.
*F25B 13/00* (2006.01)
*F25B 41/20* (2021.01)
(Continued)

(52) U.S. Cl.
CPC ..... *F25B 13/00* (2013.01); *F25B 41/20* (2021.01); *F25B 41/31* (2021.01); *F25B 47/02* (2013.01);
(Continued)

(58) Field of Classification Search
CPC ..... F25B 13/00; F25B 41/20; F25B 41/31; F25B 47/02; F25B 2313/02332;
(Continued)

(56) References Cited

U.S. PATENT DOCUMENTS 4,373,350 A 2/1983 Noland
4,563,877 A 1/1986 Harnish
(Continued)

FOREIGN PATENT DOCUMENTS

CN 102853583 A 1/2013
CN 108131858 A 6/2018
(Continued)

OTHER PUBLICATIONS

International Serach Report for International Application No. PCT/US2019/049668, International Filing Date Sep. 5, 2019, Date of Mailing Nov. 15, 2019, 5 pages.
(Continued)

*Primary Examiner* — Nelson J Nieves
*Assistant Examiner* — Matthew John Moscola
(74) *Attorney, Agent, or Firm* — CANTOR COLBURN LLP

(57) ABSTRACT

A heat pump system, a defrosting method for the heat pump system, and a controller. The heat pump system includes a heat exchanger assembly for exchanging heat with a fluid medium, the heat exchanger assembly comprised a first heat exchanger and a second heat exchanger arranged in parallel, the second heat exchanger being arranged upstream of the first heat exchanger in the flow direction of the fluid medium, and when the heat pump system is operating in a heating mode and the temperature and/or ambient humidity to which the heat exchanger assembly is currently exposed
(Continued)

reach a pre-set value, the second heat exchanger and the first heat exchanger function as a condenser and an evaporator, respectively.

15 Claims, 5 Drawing Sheets

(51) Int. Cl.
*F25B 41/31* (2021.01)
*F25B 47/02* (2006.01)

(52) U.S. Cl.
CPC ..... *F25B 2313/02332* (2013.01); *F25B 2313/02334* (2013.01); *F25B 2313/02742* (2013.01); *F25B 2500/31* (2013.01); *F25B 2700/02* (2013.01)

(58) Field of Classification Search
CPC ..... F25B 2313/02334; F25B 2313/02742; F25B 2500/31; F25B 2700/02; F25B 49/02
See application file for complete search history.

(56) References Cited

U.S. PATENT DOCUMENTS

| | | | | |
|---|---|---|---|---|
| 5,105,629 | A | 4/1992 | Parris et al. | |
| 5,771,699 | A | 6/1998 | Ponder | |
| 5,839,292 | A | 11/1998 | Hwang | |
| 6,021,644 | A | 2/2000 | Ares et al. | |
| 7,171,817 | B2 | 2/2007 | Birgen | |
| 7,213,407 | B2 | 5/2007 | Hu | |
| 7,614,249 | B2 | 11/2009 | Hu | |
| 7,802,441 | B2 | 9/2010 | Seefeldt | |
| 11,378,298 | B2 * | 7/2022 | Park | F24F 11/74 |
| 2005/0166620 | A1 * | 8/2005 | Bussjager | F24F 3/153 62/93 |
| 2009/0090129 | A1 * | 4/2009 | Ikegami | F25B 41/00 62/500 |
| 2010/0114384 | A1 * | 5/2010 | Maxwell | F24D 15/00 700/276 |
| 2014/0150479 | A1 | 6/2014 | Qu et al. | |

FOREIGN PATENT DOCUMENTS

| | | | |
|---|---|---|---|
| EP | 2236383 | A2 | 10/2010 |
| EP | 3282211 | A1 | 2/2018 |
| KR | 100531653 | B1 | 11/2005 |
| KR | 1020130029916 | A | 3/2013 |
| KR | 101867858 | B1 | 6/2018 |
| WO | 2012046947 | A1 | 4/2012 |

OTHER PUBLICATIONS

Written Opinion for International Application No. PCT/US2019/049668, International Filing Date Sep. 5, 2019, Date of Mailing Nov. 15, 2019, 9 pages.

* cited by examiner

HEAT PUMP SYSTEM, DEFROSTING METHOD FOR A HEAT PUMP SYSTEM, AND CONTROLLER

CROSS REFERENCE TO RELATED APPLICATIONS

This application is a National Stage application of PCT/US2019/049668, filed Sep. 5, 2019, which claims the benefit of China Application No. 201811073685.7, filed Sep. 14, 2018, both of which are incorporated by reference in their entirety herein.

FIELD OF THE INVENTION

The present invention relates to the technical field of heat exchanging, in particular, to a heat pump system, a defrosting method for a heat pump system, and a controller.

BACKGROUND

When using a heat pump system, the coils therein that are, for example, typically Round Tube Plate Fin (RTPF), will frost under a condition of lower temperature and higher humidity. In particular, the outer coils have the earliest and most severe frosting. Frosting will adversely affect the operation of the heat pump system, such as weakening the heating capacity and the coefficient of performance (COP), reducing the heating operation time of the heat pump system, and so on. It should be noted that the contents of this section are only for the description and understanding of the present invention and should not be construed as prior art because they are included in this section.

SUMMARY OF THE INVENTION

In view of the foregoing, the present invention provides a heat pump system, a defrosting method for a heat pump system, and a controller, thereby one or more of the existing problems described above as well as problems of other aspects having been effectively resolved or at least relieved.

Firstly, according to the first aspect of the present invention, a heat pump system is provided, which comprises a heat exchanger assembly for exchanging heat with a fluid medium, wherein the heat exchanger assembly comprises a first heat exchanger and a second heat exchanger arranged in parallel, the second heat exchanger being arranged upstream of the first heat exchanger in the flow direction of the fluid medium, and when the heat pump system is operating in a heating mode and the temperature and/or ambient humidity to which the heat exchanger assembly is currently exposed reach a pre-set value, the second heat exchanger and the first heat exchanger function as a condenser and an evaporator, respectively.

In the heat pump system according to the present invention, optionally, the second heat exchanger and the first heat exchanger both function as condensers when the heat pump system is operating in the heating mode and the temperature and/or ambient humidity reach a set value, the set value of the temperature being less than the pre-set value of the ambient temperature, and the set value of the ambient humidity being greater than the pre-set value of the ambient humidity.

In the heat pump system according to the present invention, optionally, the heat exchanger assembly further comprises one or more additional heat exchangers arranged in parallel or in series with the first heat exchanger, and/or in parallel or in series with the second heat exchanger.

In the heat pump system according to the present invention, optionally, the second heat exchanger is configured to enable the amount of heat exchange thereof with the fluid medium to be not greater than the amount of heat exchange between the first heat exchanger and the fluid medium.

In the heat pump system according to the present invention, optionally, the heat pump system comprises:

- a first four-way reversing valve having an interface D, an interface C connected to a first port of the first heat exchanger, an interface S, and an interface E;
- a second four-way reversing valve having an interface D, an interface C connected to a first port of the second heat exchanger, an interface S, and an interface E;
- a compressor having a discharge port connected to the interface D of the first four-way reversing valve and the interface D of the second four-way reversing valve, and a suction port connected to the interface S of the first four-way reversing valve and the interface S of the second four-way reversing valve;
- a cooler having a port connected to the interface E of the first four-way reversing valve and the interface E of the second four-way reversing valve, and another port connected to a second port of the first heat exchanger and a second port of the second heat exchanger; and
- a check valve disposed between the interface E of the second four-way reversing valve and the cooler, for preventing the heat exchanging medium in the heat pump system from returning to the interface E of the second four-way reversing valve.

In the heat pump system according to the present invention, optionally, the heat pump system further comprises:

- a first electronic expansion valve disposed between the another port of the cooler and the second port of the first heat exchanger; and/or
- a second electronic expansion valve disposed between the another port of the cooler and the second port of the second heat exchanger.

In the heat pump system according to the present invention, optionally, the heat pump system further comprises a bypass disposed between the another port of the cooler and the second port of the second heat exchanger, and provided with a solenoid valve being closed when the heat pump system is operating in a cooling mode and being closed when the heat pump system is operating in the heating mode and the second heat exchanger and the first heat exchanger both function as evaporators, and a check valve for preventing the heat exchanging medium in the heat pump system from returning to the second port of the second heat exchanger.

In the heat pump system according to the present invention, optionally, the heat pump system comprises:

- a first four-way reversing valve having an interface D, an interface C connected to a first port of the first heat exchanger, an interface S, and an interface E;
- a second four-way reversing valve having an interface D, an interface C connected to a first port of the second heat exchanger, an interface S, and an interface E;
- a compressor having a discharge port connected to the interface D of the first four-way reversing valve and the interface D of the second four-way reversing valve, and a suction port connected to the interface S of the first four-way reversing valve and the interface S of the second four-way reversing valve;
- a cooler having a port connected to the interface E of the first four-way reversing valve, and another port connected to a second port of the first heat exchanger and a second port of the second heat exchanger; and a bypass device disposed between the interface E and the interface S of the second four-way reversing valve.

In the heat pump system according to the present invention, optionally, the bypass device includes a capillary tube, and a throttle tube.

In the heat pump system according to the present invention, optionally, the heat pump system further comprises:

a first electronic expansion valve disposed between the another port of the cooler and the second port of the first heat exchanger; and/or a second electronic expansion valve disposed between the another port of the cooler and the second port of the second heat exchanger.

In the heat pump system according to the present invention, optionally, the heat pump system further comprises a bypass disposed between the another port of the cooler and the second port of the second heat exchanger, and provided with a solenoid valve being closed when the heat pump system is operating in a cooling mode and being closed when the heat pump system is operating in the heating mode and the second heat exchanger and the first heat exchanger both function as evaporators, and a check valve for preventing the heat exchanging medium in the heat pump system from returning to the second port of the second heat exchanger.

In the heat pump system according to the present invention, optionally, the fluid medium is air.

Secondly, according to the second aspect of the present invention, it is provided a defrosting method for a heat pump system, comprising the steps of:

operating the heat pump system according to any one of the above descriptions in a heating mode;

obtaining the temperature and/or ambient humidity to which the heat exchanger assembly in the heat pump system is currently exposed; and determining whether the obtained temperature and/or ambient humidity reach a pre-set value, and if yes, enabling the second heat exchanger and the first heat exchanger in the heat exchanger assembly to function as a condenser and an evaporator, respectively.

The defrosting method for a heat pump system according to the present invention, optionally, further comprises the steps of:

in the heating mode, obtaining the temperature and/or ambient humidity to which the heat exchanger assembly is currently exposed; and determining whether the obtained temperature and/or ambient humidity reach a set value, and if yes, enabling the second heat exchanger and the first heat exchanger to both function as condensers, the set value of the temperature being less than the pre-set value of the ambient temperature, and the set value of the ambient humidity being greater than the pre-set value of the ambient humidity.

Additionally, according to the third aspect of the present invention, it is provided a controller, which comprises a processor and a storage for storing instructions, wherein the processor, when the instructions are executed, implements the defrosting method for a heat pump system according to any one of the above descriptions.

From the following descriptions in combination with the drawings, one will clearly understand the principles, characteristics, features and advantages of various technical solutions of the present invention. For example, it will be understood that, in comparison with the prior art, the technical solutions of the present invention can effectively prevent or reduce frosting of the heat exchanger in the heat pump system, thereby avoiding adverse effects on the operation of the heat pump system, helping to enhance the heating capacity of the heat pump system, prolonging the heating operation time, improving the coefficient of performance (COP), and so on.

BRIEF DESCRIPTION OF THE DRAWINGS

The technical solutions of the present invention will be further described in detail below in conjunction with the drawings and embodiments. However, it should be understood that the drawings are designed merely for illustrative purpose and are intended only to conceptually explain the configurations described herein. It is unnecessary to draw the drawings in proportion.

DETAILED DESCRIPTION OF THE INVENTION

Figure 1:
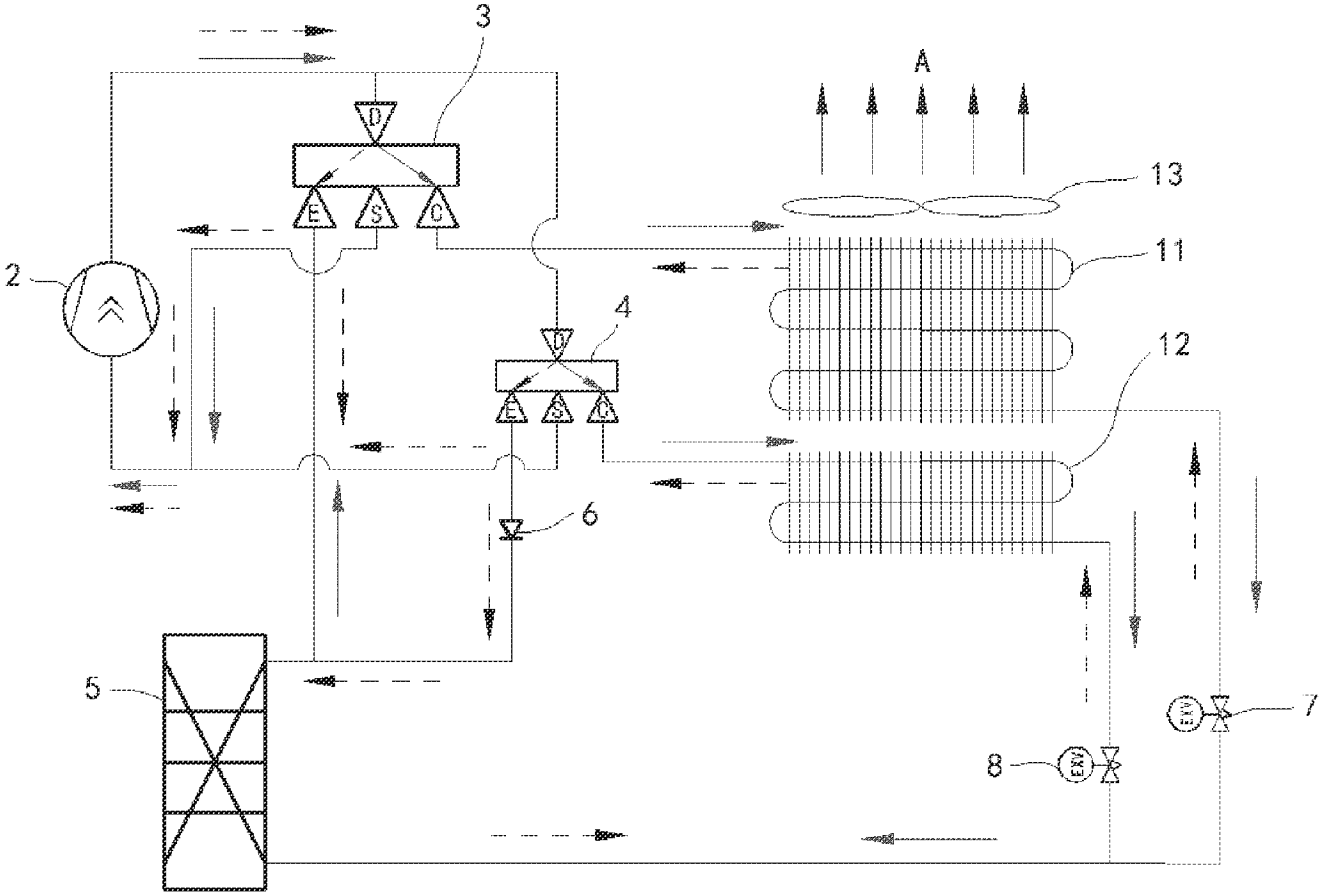
FIG. 1 is a schematic view showing the composition of a heat pump system in accordance with an embodiment of the present invention.

First, it should be noted that the configurations, steps, features, and advantages of the heat pump system, the defrosting method for the heat pump system and the controller according to the present invention will be described hereinafter by way of examples. All the descriptions, however, are only for the purpose of illustration and should not be construed, in any way, as limiting the scope of the invention. In the context of the present application, the technical terms "first" and "second" are used merely for discriminating purposes and are not intended to indicate their order or relative importance.

Moreover, as for any single technical feature described or implied in the embodiments mentioned herein, or any single technical feature described or implied in the various figures, the present invention still allows any further combination or deletion of these technical features (or equivalents thereof), and therefore it should be considered that more of such embodiments according to the invention are also within the scope of the disclosure contained in the application. In addition, the same or similar components and features may be labeled in only one or several places in the same drawing for the sake of simplicity of the drawing.

First of all, according to the design concept of the present invention, a heat pump system is innovatively provided, which can prevent or reduce frosting of heat exchangers such as coils and microchannel heat exchangers, in the heat pump system under a condition, for example, a lower temperature or a higher humidity, thereby bringing excellent technical effects such as enhancing the heating capacity of the heat pump system, prolonging the heating operation time, and improving the coefficient of performance (COP).

By way of example, a heat pump system in accordance with an embodiment of the present invention is schematically illustrated in FIG. 1. In this embodiment, the heat pump system may comprise a heat exchanger assembly 1, a compressor 2, a first four-way reversing valve 3, a second four-way reversing valve 4 and a cooler 5. The heat pump system of the invention will be described in detail below by means of this embodiment.

As shown in FIG. 1, the heat exchanger assembly 1 comprises a first heat exchanger 11 and a second heat exchanger 12. The two heat exchangers are arranged in parallel for exchanging heat with the fluid medium (e.g., air) that flows therethrough, and the second heat exchanger 12 is arranged upstream of the first heat exchanger 11 along the flow direction A of the fluid medium. In specific applications, the parameters, such as the volume and flow rate, of the fluid medium flowing through the heat exchanger assembly 1 may be controlled by means of a device such as a fan 13, so as to better meet the actual requirements of the applications.

In the embodiment shown in FIG. 1, the first four-way reversing valve 3 and the second four-way reversing valve 4 are arranged to effect, in the circulation loop, the flow direction switching of the heat exchange medium such as refrigerant liquid, gas or gas-liquid mixture in the heat pump system.

Specifically, the first four-way reversing valve 3 has four interfaces, namely, the interface D, the interface C, the interface S, and the interface E shown in FIG. 1. The interface D and the interface S of the first four-way reversing valve 3 may be connected to the discharge port and the suction port of the compressor 2 respectively, the interface C may be connected to the first port 111 (FIG. 2) of the first heat exchanger 11, and the interface E may be connected to a port of the cooler 5.

The second four-way reversing valve 4 has an interface D, an interface C, an interface S, and an interface E. The interface D and the interface S of the second four-way reversing valve 4 may be connected to the discharge port and the suction port of the compressor 2 respectively, the interface C may be connected to the first port 121 (FIG. 2) of the second heat exchanger 12, and the interface E may be connected to the above-mentioned port of the cooler 5.

Furthermore, in this embodiment, the cooler 5 is a device for providing a cooling process to the heat exchange medium in the heat pump system. A port of the cooler 5 is connected to respective E ports of the first four-way reversing valve 3 and the second four-way reversing valve 4, and the other port of the cooler 5 is connected to the second port 112 of the first heat exchanger 11 and the second port 122 of the second heat exchanger 12.

In addition, a check valve 6 may also be disposed between the interface E of the second four-way reversing valve 4 and the cooler 5. The use of the check valve 6 can prevent the reflux of the heat exchange medium toward the interface E of the second four-way reversing valve.

Furthermore, depending on actual applications, a first electronic expansion valve 7 may be disposed between the cooler 5 and the second port 112 of the first heat exchanger 11 to control the flow of the heat exchange medium in the conduit. Similarly, a second electronic expansion valve 8 may be disposed between the cooler 5 and the second port 122 of the second heat exchanger 12 to control the flow of the heat exchange medium in the conduit.

As shown in FIG. 1, this embodiment of the heat pump system can operate in a working mode such as a cooling mode or a heating mode. The flow direction of the heat exchange medium in the circulation loop of the heat pump system in the cooling mode is indicated by solid arrows in FIG. 1. Also, the flow direction of the heat exchange medium in the circulation loop of the heat pump system in the heating mode is indicated by a dashed arrow in FIG. 1.

When the heat pump system is operating in the cooling mode, a portion of the heat exchange medium will flow out of the discharge port of the compressor 2 in the direction indicated by the solid arrow in FIG. 1, and then sequentially flow through the first four-way reversing valve 3 (flowing in from the interface D, and then flowing out of the interface C), the first heat exchanger 11, the first electronic expansion valve 7, the cooler 5, the first four-way reversing valve 3 (flowing in from the interface E, and then flowing out of the interface S), and finally return to the suction port of the compressor 2, thereby forming a flow circulation loop. At this time, the first heat exchanger 11 in the heat exchanger assembly 1 functions as a condenser to release heat to the outside, that is, heats the fluid medium flowing through the first heat exchanger 11 to elevate its temperature, and therefore no frosting will occur at the first heat exchanger 11.

In addition, when the heat pump system is operating in the cooling mode, another portion of the heat exchange medium will flow out of the discharge port of the compressor 2 in the direction indicated by the solid arrow in FIG. 1, and then sequentially flow through the second four-way reversing valve 4 (flowing in from the interface D, and then flowing out of the interface C), the second heat exchanger 12, the second electronic expansion valve 8, the cooler 5, and the second four-way reversing valve 4 (flowing in from the interface E, and then flowing out of the interface S), and finally return to the suction port of the compressor 2, thereby forming another flow circulation loop. At this time, the second heat exchanger 12 in the heat exchanger assembly 1 also functions as a condenser to release heat to the outside, that is, heats the fluid medium flowing through the second heat exchanger 12 to elevate its temperature, and therefore no frosting problem will occur at the second heat exchanger 12 either.

Referring to FIG. 1 again, when the heat pump system is operating in the heating mode, a portion of the heat exchange medium will flow out of the discharge port of the compressor 2 in the direction indicated by the dashed arrow in FIG. 1, and then sequentially flow through the first four-way reversing valve 3 (flowing in from the interface D, and then flowing out of the interface E), the cooler 5, the first electronic expansion valve 7, the first heat exchanger 11, the first four-way reversing valve 3 (flowing in from the interface C, and then flowing out of the interface S), and finally return to the suction port of the compressor 2, thereby forming a flow circulation loop. At this time, the first heat exchanger 11 in the heat exchanger assembly 1 functions as an evaporator to absorb heat from the outside, and thus the frosting problem might probably occur under some conditions such as when the temperature of the heat exchanger is low, the ambient temperature is low, or the ambient humidity is high.

Additionally, when the heat pump system is operating in the heating mode, another portion of the heat exchange medium will flow out of the discharge port of the compressor 2 in the direction indicated by the dashed arrow in FIG. 1, and then sequentially flow through the second four-way reversing valve 4 (flowing in from the interface D, and then flowing out of the interface E), the cooler 5, the second electronic expansion valve 8, the second heat exchanger 12, the second four-way reversing valve 4 (flowing in from the interface C, then flowing out of the interface S), and finally return to the suction port of the compressor 2, thereby forming a flow circulation loop. At this time, the first heat exchanger 11 in the heat exchanger assembly 1 also functions as an evaporator to absorb heat from the outside, and thus the frosting problem also might probably occur under some conditions such as when the temperature of the heat exchanger is low, the ambient temperature is low, or the ambient humidity is high.

In order to overcome the problems described above, according to the design concept of the present invention, the temperature (or ambient humidity) to which the heat exchanger assembly 1 is currently exposed may be obtained, and then the obtained temperature (or ambient humidity) is compared with a pre-set value thereof. If the obtained value is found to have been lower than the pre-set value, the second heat exchanger 12 can then be enabled to function as a condenser to release heat to the outside. Since the second heat exchanger 12 is disposed upstream of the first heat exchanger 11, it will exchange heat with the fluid medium flowing through the heat exchanger assembly 1 prior to the first heat exchanger 11 does. The heat released by the second heat exchanger 12 can therefore be used to heat up the fluid medium exchanging heat therewith, thereby removing or avoiding the formation of frost on the second heat exchanger 12, and solving or mitigating the frosting problem of the first heat exchanger 11 that the fluid medium subsequently flows through. By means of the approach stated above, the first heat exchanger 11 can function as an evaporator for a longer time. That is to say, the heat pump system can be continuously operated in the heating mode without frequent defrosting. Therefore, the heating capacity of the heat pump system is enhanced, and more heating time can be obtained by users.

It should be understood that since the circumstances under which the second heat exchanger 12 functions as a condenser or an evaporator respectively have been described above in detail, the second four-way reversing valve 4 can be controlled as set forth previously to switch for changing the flow direction of the heat exchange medium. That is, after the heat exchange medium flows out of the compressor 2, it flows in from the interface D and then flows out of the interface E of the second four-way reversing valve 4, so that the second heat exchanger 12 operates as a condenser to avoid or alleviate the formation of frost at the second heat exchanger 12 and the first heat exchanger 11.

Of course, it should also be understood that, optionally, not only the afore-mentioned temperature or ambient humidity may be separately considered as a determining condition, but also they may be jointly taken into consideration as a determining condition. That is to say, the second heat exchanger 12 can be operated as a condenser when the temperature reaches its pre-set value and at the same time the ambient humidity also reaches its pre-set value.

The measurement and acquisition of the temperature (the temperature of the heat exchanger or the ambient temperature) or the ambient humidity can be achieved in a variety of ways. For example, measurement can be performed by setting up a temperature sensor, a humidity sensor, etc. Since such a temperature sensor or humidity sensor has been provided in some of the existing heat pump systems, parameters such as temperature and/or ambient humidity may also be obtained directly from these existing sensors.

In addition, with respect to the pre-set values of the temperature and the ambient humidity, the present invention allows for various possible and flexible settings, changes, and adjustments depending on actual applications. For example, the above pre-set values may be selected in accordance with the experimental data and/or empirical data related to the performance of the heat pump system, the historical weather data of the place where the heat pump system is installed, user's demands, and so on. For example, there might be significant differences in the conditions under which frost forms on a heat exchanger for different geographical environments.

Optionally, the heat exchanger 12 and the first heat exchanger 11 can both function as condensers when the heat pump system is in the heating mode, if the temperature and/or ambient humidity of the heat exchanger assembly 1 currently reach a set value. For example, the set value of the temperature is less than the afore-mentioned pre-set value of the ambient temperature, or the set value of the ambient humidity is greater than the afore-mentioned pre-set value of the ambient humidity. Both circumstances may worsen the condition under which frosting might occur. In other words, under circumstances where the frosting problem tends to be worse, the first heat exchanger 11 can also be used as a condenser to increase the amount of heat released to the outside in order to remove the frost layer formed on the heat exchanger 12 and the first heat exchanger 11 of the heat exchanger assembly 1, i.e. the heat pump system has now entered into a full defrosting mode.

It can also be understood that since the circumstances under which the first heat exchanger 11 is used as a condenser or an evaporator respectively have been described above in detail, the first four-way reversing valve 3 can be controlled as set forth previously to switch for changing the flow direction of the heat exchange medium, so that the first heat exchanger 11 operates as a condenser.

In addition, with respect to the set values of the temperature and the ambient humidity, the present invention also allows for various possible and flexible settings, changes, and adjustments depending on actual applications. For example, the above set values may be selected in accordance with the experimental data and/or empirical data related to the performance of the heat pump system, the historical weather data of the place where the heat pump system is installed, user's demands, and so on. For example, there might be significant differences in the conditions under which frost forms on a heat exchanger for different geographical environments.

The heat exchanger assembly 1 can be flexibly designed, according to the requirements of actual applications, without departing from the spirit of the present invention.

Figure 2:
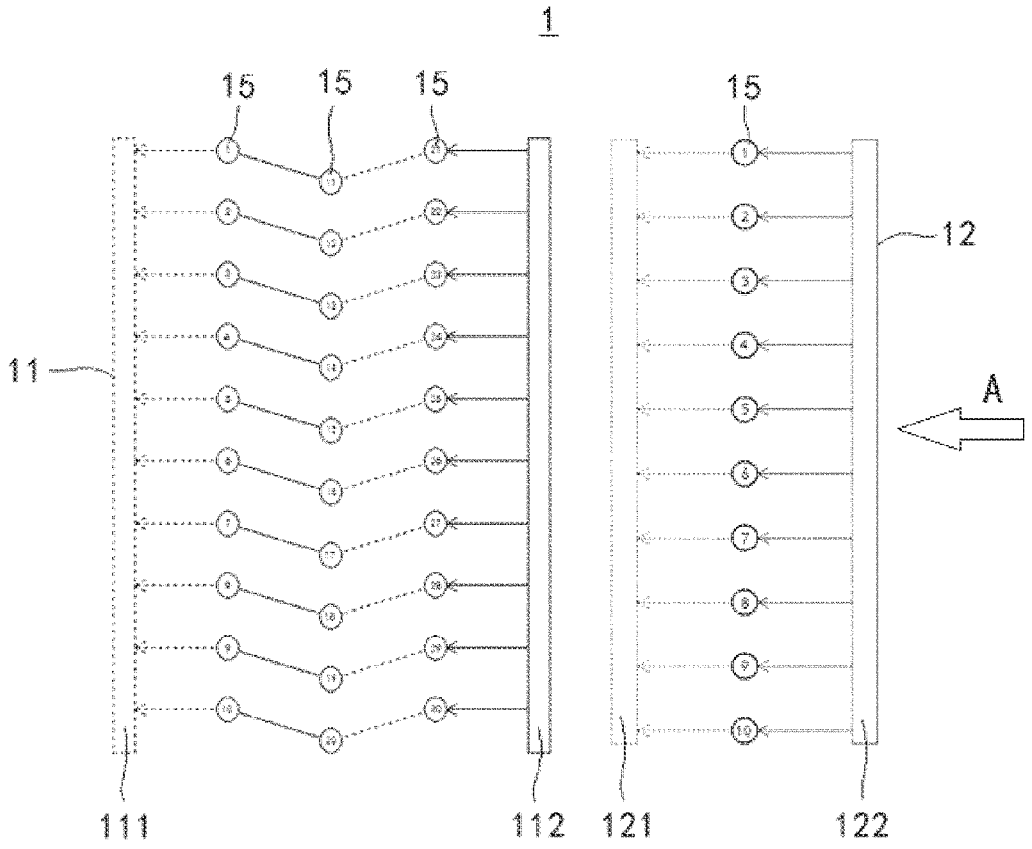
FIG. 2 is a partial schematic view of the heat exchanger assembly in the embodiment of the heat pump system illustrated in FIG. 1.

By way of example, a partial configuration of the heat exchanger assembly in the embodiment of the heat pump system described above is schematically illustrated in FIG. 2. As shown in FIG. 2, the first heat exchanger 11 and the second heat exchanger 12 are arranged in parallel, and the fluid medium will firstly flow through the second heat exchanger 12 and then flow through the first heat exchanger 11 in the direction indicated by the arrow A in the figure, thereby exchanging heat with them. Depending on the requirements of applications, the number of rows, length, diameter, shape, material, and the like of the respective heat exchange tubes 15 in the first heat exchanger 11 and the second heat exchanger 12 can be flexibly selected.

For example, the second heat exchanger 12 can be optionally configured to have a relatively smaller amount of heat exchange with the fluid medium as compared to the first heat exchanger 11. In this way, on one hand, the second heat exchanger 12 can be used as a condenser to provide heat for solving or alleviating the frosting problem of the heat exchanger, and on the other hand, it will help to utilize the first heat exchanger 11, which has a relatively larger capacity of heat exchange, to go on ensuring the heating function of the heat pump system.

As another example, optionally, one or more additional heat exchangers (not shown) may be added to the heat exchanger assembly 1. All of the additional heat exchangers may be arranged in parallel or in series with the first heat exchanger 11 (or the second heat exchanger 12), or some of the additional heat exchangers may be arranged in parallel or in series with the first heat exchanger 11, and the others of the additional heat exchangers are arranged in parallel or in series with the second heat exchanger 12. The specific arrangements can be determined according to the requirements of actual applications.

Figure 3:
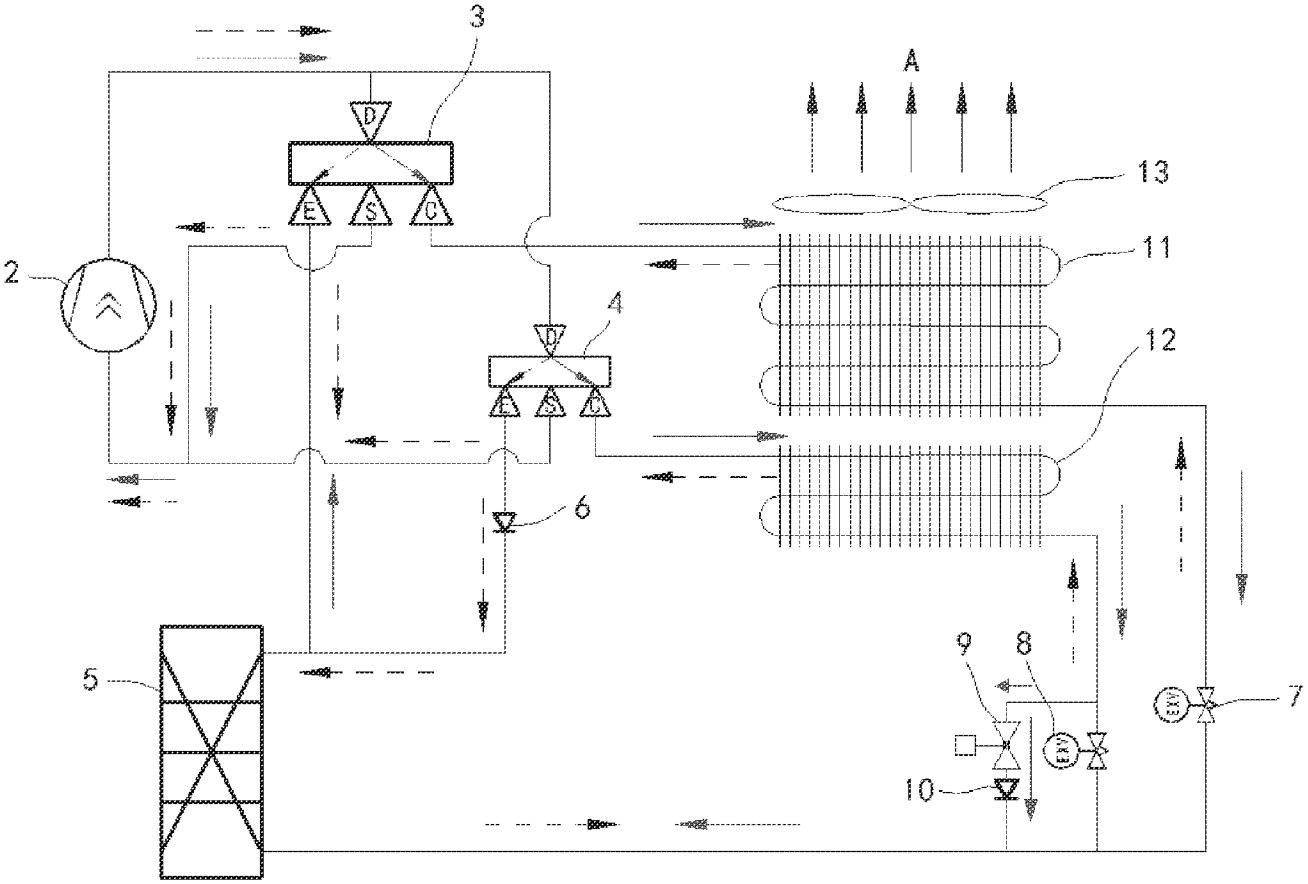
FIG. 3 is a schematic view showing the composition of the heat pump system in accordance with another embodiment of the present invention.
Figure 4:
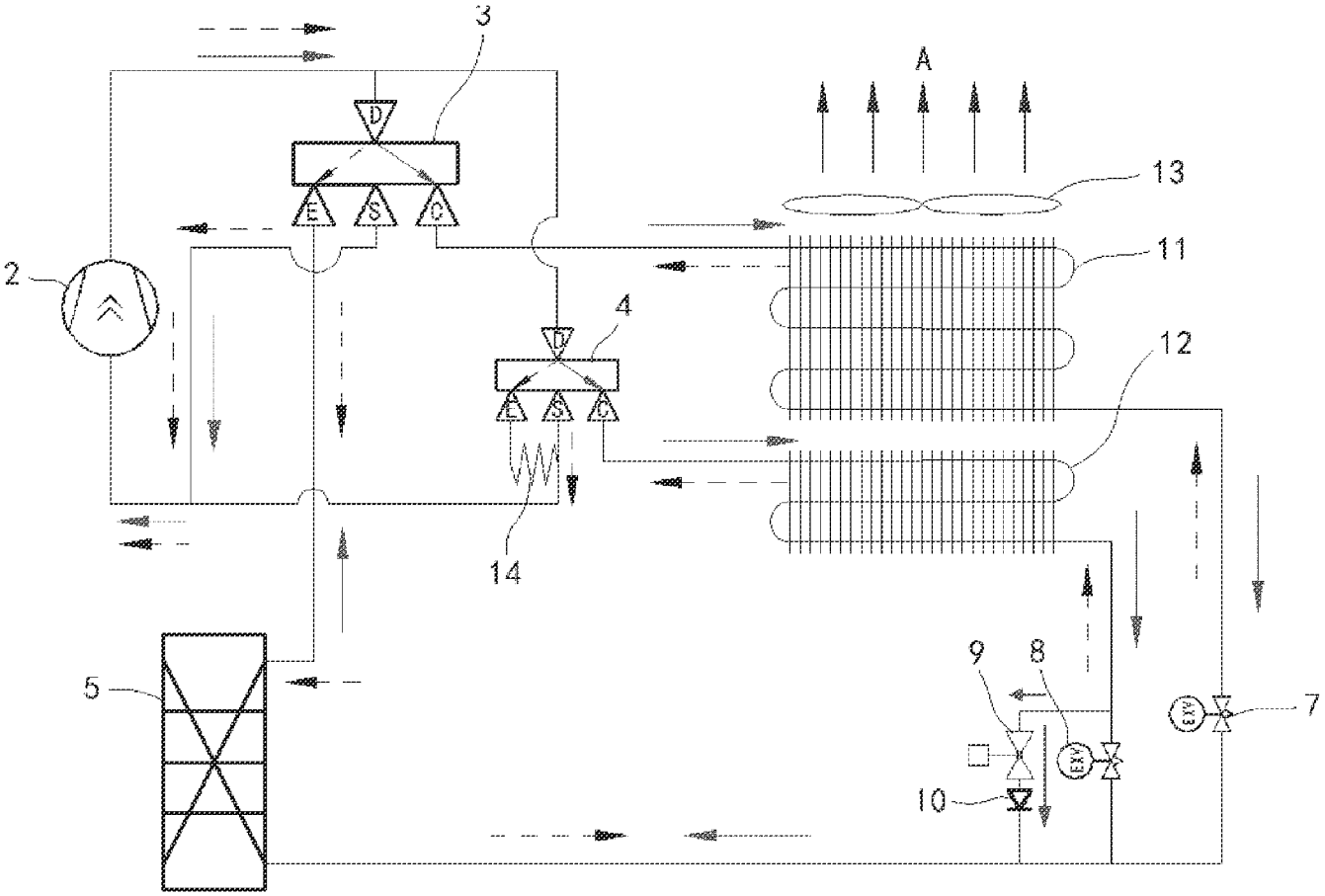
FIG. 4 is a schematic view showing the composition of the heat pump system in accordance with yet another embodiment of the present invention.

Next, two other embodiments of the heat pump system according to the present invention are shown in FIGS. 3 and 4, respectively. Since a very detailed discussion in regard of the first embodiment has been made herein with reference to FIGS. 1 and 2, the technical contents in the embodiments shown in FIGS. 3 and 4 which are the same or similar with those of FIGS. 1 and 2 can be referred to the corresponding discussions set forth above with regard to the first embodiment, and no details are repeated herein for the sake of simplicity.

In the embodiment of the heat pump system shown in FIG. 3, a bypass is added between the cooler 5 and the second port 122 of the second heat exchanger 12, so that when the flow volume is controlled only by fully opening the second electronic expansion valve 8 as indicated in FIG. 1, no flash distillation will occur downstream thereof due to an undesired pressure drop. As shown in FIG. 3, a solenoid valve 9 and a check valve 10 are arranged in the bypass. The check valve 10 is provided to prevent the heat exchange medium in the heat pump system from returning to the second port 122 of the second heat exchanger 12. The solenoid valve 9 is closed when the heat pump system is operating in the cooling mode, and it is also closed when the heat pump system is operating in the heating mode and both the second heat exchanger 12 and the first heat exchanger 11 function as evaporators. The solenoid valve 9 is open when the first heat exchanger 11 is used as an evaporator and the second heat exchanger 12 is used as a condenser, thereby providing a bypass passage where the heat exchange medium can flow through.

Referring next to FIG. 4, in the embodiment of the heat pump system shown in this figure, the conduit connecting the interface E of the second four-way reversing valve 4 to the cooler 5, and the check valve 6 have been removed in comparison with the embodiment of the heat pump system shown in FIG. 1. The interface B of the second four-way reversing valve 4 is connected to the interface S via a bypass device 14 (e.g., a capillary tube, a throttle tube), and the heat exchange medium, in the heating mode (or the cooling mode), will flow in the direction indicated by the dashed arrow (or the solid arrow) shown in FIG. 4. This can provide more flexibility for applying the heat pump system of the invention.

Figure 5:
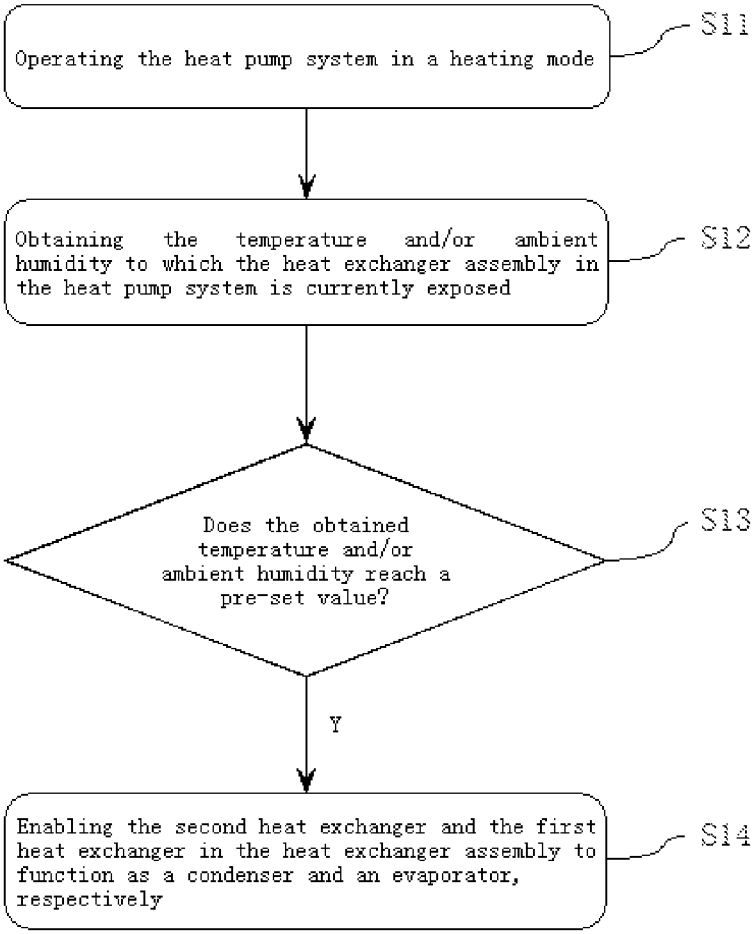
FIG. 5 is a flow chart illustrating an embodiment of the defrosting method for a heat pump system in accordance with the present invention.

As an aspect that is significantly superior to the prior art, the present invention also provides a defrosting method for a heat pump system. By way of example, as shown in FIG. 5, the embodiment of the defrosting method may include the following steps:

In step S11, operating the heat pump system provided according to the invention in a heating mode;

In step S12, obtaining the temperature and/or the ambient humidity to which the heat exchanger assembly in the heat pump system is currently exposed;

In step S13, determining whether the temperature and/or the ambient humidity reach a pre-set value, according to the obtained temperature and/or the ambient humidity;

In step S14, if it is determined that the temperature and/or the ambient humidity have reached the pre-set value, enabling the second heat exchanger and the first heat exchanger in the heat exchanger assembly to function as a condenser and an evaporator, respectively. As such, the frosting problem of the heat exchanger as described above can be avoided or alleviated, and the heat pump system can be continuously operated in the heating mode without frequent defrosting. As a result, more heating operation time is available to users, the heating capacity of the heat pump system is effectively enhanced, and the coefficient of performance (COP) can be improved.

In some optional embodiments, the defrosting method may further include the following steps:

when the heat pump system is operating in the heating mode, obtaining the temperature and/or ambient humidity to which the heat exchanger assembly is currently exposed, and then determining whether the obtained temperature and/or ambient humidity reach the set value, and if yes, the second heat exchanger and the first heat exchanger in the heat exchanger assembly are both used as condensers.

It can be understood that a person of ordinary skill in the art is able to directly refer to the detailed discussions of the corresponding contents described above and thus no repetition is provided herein, due to the fact that the technical contents such as the configuration, operation mode and characteristics of the first heat exchanger, the configuration, operation mode and characteristics of the second heat exchanger, the acquisition of the temperature and ambient humidity, and the respective pre-set value and set value, have already been described in detail above.

Furthermore, the present invention provides a controller comprising a processor and a storage for storing instructions, wherein the processor, when the instructions are executed, can implement the defrosting method for a heat pump system according to the present invention as exemplarily described herein above by way of example. In a specific embodiment, the controller can be arranged in any suitable component, functional module or device in the heat pump system.

The heat pump system, the defrosting method for a heat pump system, and the controller according to the present invention haven been exemplified in detail by way of example only, and these examples are merely illustrative of the principles of the present invention and its embodiments, rather than any limitation to the invention. Various modifications and improvements can be made by those skilled in the art without departing from the spirit and scope of the invention. Therefore, all the equivalent technical solutions shall fall into the scope of the invention and are covered by the accompanying claims.

The invention claimed is:

1. A heat pump system, comprising a heat exchanger assembly for exchanging heat with a fluid medium, wherein the heat exchanger assembly comprises a first heat exchanger and a second heat exchanger arranged in parallel, the second heat exchanger being arranged upstream of the first heat exchanger in the flow direction of the fluid medium, and when the heat pump system is operating in a heating mode and a temperature and/or an ambient humidity to which the heat exchanger assembly is currently exposed reach a pre-set value, the second heat exchanger and the first heat exchanger function as a condenser and an evaporator, respectively, wherein the heat pump system comprises:

a first four-way reversing valve having an interface D, an interface C connected to a first port of the first heat exchanger, an interface S, and an interface E;

a second four-way reversing valve having an interface D, an interface C connected to a first port of the second heat exchanger, an interface S, and an interface E;

a compressor having a discharge port connected to the interface D of the first four-way reversing valve and the interface D of the second four-way reversing valve, and a suction port connected to the interface S of the first four-way reversing valve and the interface S of the second four-way reversing valve;

a cooler having a port connected to the interface E of the first four-way reversing valve and the interface E of the second four-way reversing valve, and another port connected to a second port of the first heat exchanger and a second port of the second heat exchanger; and a check valve disposed between the interface E of the second four-way reversing valve and the cooler, for preventing a heat exchanging medium in the heat pump system from returning to the interface E of the second four-way reversing valve.

2. The heat pump system according to claim 1, wherein the second heat exchanger and the first heat exchanger both function as condensers when the heat pump system is operating in the heating mode and the temperature and/or ambient humidity reach a set value, the set value of the temperature being less than the pre-set value of an ambient temperature, and the set value of the ambient humidity being greater than the pre-set value of the ambient humidity.

3. The heat pump system according to claim 1, wherein the heat exchanger assembly further comprises one or more additional heat exchangers arranged in parallel or in series with the first heat exchanger, and/or in parallel or in series with the second heat exchanger.

4. The heat pump system according to claim 1, wherein the second heat exchanger is configured to enable the amount of heat exchange thereof with the fluid medium to be not greater than the amount of heat exchange between the first heat exchanger and the fluid medium.

5. The heat pump system according to claim 1, further comprising:

a first electronic expansion valve disposed between the another port of the cooler and the second port of the first heat exchanger; and/or a second electronic expansion valve disposed between the another port of the cooler and the second port of the second heat exchanger.

6. The heat pump system according to claim 5, further comprising a bypass disposed between the another port of the cooler and the second port of the second heat exchanger, and provided with a solenoid valve being closed when the heat pump system is operating in a cooling mode and being closed when the heat pump system is operating in the heating mode and the second heat exchanger and the first heat exchanger both function as evaporators, and a check valve for preventing the heat exchanging medium in the heat pump system from returning to the second port of the second heat exchanger.

7. A heat pump system, comprising a heat exchanger assembly for exchanging heat with a fluid medium, wherein the heat exchanger assembly comprises a first heat exchanger and a second heat exchanger arranged in parallel, the second heat exchanger being arranged upstream of the first heat exchanger in the flow direction of the fluid medium, and when the heat pump system is operating in a heating mode and the temperature and/or ambient humidity to which the heat exchanger assembly is currently exposed reach a pre-set value, the second heat exchanger and the first heat exchanger function as a condenser and an evaporator, respectively, wherein the heat pump system comprises:

a first four-way reversing valve having an interface D, an interface C connected to a first port of the first heat exchanger, an interface S, and an interface E;

a second four-way reversing valve having an interface D, an interface C connected to a first port of the second heat exchanger, an interface S, and an interface E;

a compressor having a discharge port connected to the interface D of the first four-way reversing valve and the interface D of the second four-way reversing valve, and a suction port connected to the interface S of the first four-way reversing valve and the interface S of the second four-way reversing valve;

a cooler having a port connected to the interface E of the first four-way reversing valve, and another port connected to a second port of the first heat exchanger and a second port of the second heat exchanger; and a bypass device disposed between the interface E and the interface S of the second four-way reversing valve.

8. The heat pump system according to claim 7, wherein the bypass device includes a capillary tube, and a throttle tube.

9. The heat pump system according to claim 7, further comprising:

a first electronic expansion valve disposed between the another port of the cooler and the second port of the first heat exchanger; and/or a second electronic expansion valve disposed between the another port of the cooler and the second port of the second heat exchanger.

10. The heat pump system according to claim 7, further comprising a bypass disposed between the another port of the cooler and the second port of the second heat exchanger, and provided with a solenoid valve being closed when the heat pump system is operating in a cooling mode and being closed when the heat pump system is operating in the heating mode and the second heat exchanger and the first heat exchanger both function as evaporators, and a check valve for preventing the heat exchanging medium in the heat pump system from returning to the second port of the second heat exchanger.

11. The heat pump system according to claim 1, wherein the fluid medium is air.

12. A defrosting method for a heat pump system, comprising the steps of:

operating the heat pump system according to claim 1 in a heating mode;

obtaining the temperature and/or ambient humidity to which the heat exchanger assembly in the heat pump system is currently exposed; and determining whether the obtained temperature and/or ambient humidity reach a pre-set value, and if yes, enabling the second heat exchanger and the first heat exchanger in the heat exchanger assembly to function as a condenser and an evaporator, respectively.

13. The defrosting method for a heat pump system according to claim 12, further comprising the steps of:

in the heating mode, obtaining the temperature and/or ambient humidity to which the heat exchanger assembly is currently exposed; and determining whether the obtained temperature and/or ambient humidity reach a set value, and if yes, enabling the second heat exchanger and the first heat exchanger to both function as condensers, the set value of the temperature being less than the pre-set value of the ambient temperature, and the set value of the ambient humidity being greater than the pre-set value of the ambient humidity.

14. A controller, comprising a processor and a storage for storing instructions, wherein the processor, when the instructions are executed, implements the defrosting method for a heat pump system according to claim 12.

15. A defrosting method for a heat pump system, comprising the steps of:

operating the heat pump system according to claim 7 in a heating mode;

obtaining the temperature and/or ambient humidity to which the heat exchanger assembly in the heat pump system is currently exposed; and determining whether the obtained temperature and/or ambient humidity reach a pre-set value, and if yes, enabling the second heat exchanger and the first heat exchanger in the heat exchanger assembly to function as a condenser and an evaporator, respectively.

* * * * *